US008438953B2

(12) United States Patent
Chen

(10) Patent No.: US 8,438,953 B2
(45) Date of Patent: May 14, 2013

(54) HAMMERING TOOL WITH BUFFER DESIGN

(76) Inventor: Kuan-Wei Chen, Taichung (TW)

( * ) Notice: Subject to any disclaimer, the term of this patent is extended or adjusted under 35 U.S.C. 154(b) by 229 days.

(21) Appl. No.: 13/012,757

(22) Filed: Jan. 24, 2011

(65) Prior Publication Data

US 2012/0186399 A1 Jul. 26, 2012

(51) Int. Cl.

| | |
|---|---|
| ***B25D 1/00*** | (2006.01) |
| ***B25D 1/12*** | (2006.01) |
| ***B25D 1/02*** | (2006.01) |
| ***B25D 1/06*** | (2006.01) |
| ***B25D 1/16*** | (2006.01) |
| ***B25C 11/00*** | (2006.01) |
| ***B66F 15/00*** | (2006.01) |

(52) U.S. Cl.
USPC ..... 81/22; 81/20; 81/21; 81/23; 81/24; 81/25; 81/27; 254/18; 254/25; 254/26 R; 254/26 E

(58) Field of Classification Search ..... 81/20–25, 81/27; 254/18, 25, 26 R, 26 E
See application file for complete search history.

(56) References Cited

U.S. PATENT DOCUMENTS

| | | | | |
|---|---|---|---|---|
| 5,280,738 | A * | 1/1994 | Liou | 81/20 |
| 6,016,722 | A * | 1/2000 | Gierer et al. | 81/22 |
| 6,945,138 | B1 * | 9/2005 | Kreitzer | 81/22 |
| 2010/0038608 | A1 * | 2/2010 | Degennaro | 254/26 R |

* cited by examiner

*Primary Examiner* — Monica Carter
*Assistant Examiner* — Danny Hong
(74) *Attorney, Agent, or Firm* — Browdy and Neimark, PLLC

(57) ABSTRACT

A hammering tool with buffer design includes: a hammering member, a protrusion block section extending from a lower side of the hammering member, a right side of upper section of the protrusion block section being notched to form a first receiving space; a handle member having a grip section, a first plate section, a second plate section and a third plate section being disposed at an upper end of the grip section to define a receiving chamber for inserting the protrusion block section therein; a pivot member for pivotally connecting the protrusion block section of the hammering member with the handle member; and a buffer assembly including a first compression spring received in the first receiving space. A right end face of the protrusion block section of the hammering member is spaced from a left face of the first plate section by a predetermined buffering distance.

6 Claims, 14 Drawing Sheets

HAMMERING TOOL WITH BUFFER DESIGN

BACKGROUND OF THE INVENTION

1. Field of the Invention

The present invention relates generally to a hand tool, and more particularly to a hammering tool with buffer design.

2. Description of the Related Art

The conventional hammers are typical hammering tools and are very popularly used to hammer work pieces. FIG. 1 shows a conventional hammer 10, which includes a hammering member 11 and a handle 12. The hammering member 11 is affixed to the handle 12 for hammering a work piece. The handle 12 is for a user to hold and operate the hammer 10.

It is known that when hammering a work piece with the hammer 10, a strong reaction force is applied and transmitted to a user's hand to shock the user's hand. After using the hammer to hammer the work piece for a period of time, such shocking force may cause an occupational disease of repeated injury to the user's hand.

SUMMARY OF THE INVENTION

It is therefore a primary object of the present invention to provide a hammering tool with buffer design. When using the hammering tool to hammer a work piece, the hammering tool is able to buffer the strong reaction force and provide anti-shock effect for a user's hand to avoid occupational disease of repeated injury.

To achieve the above and other objects, the hammering tool with buffer design of the present invention includes: a hammering member, a protrusion block section extending from a lower side of the hammering member, a right side of upper section of the protrusion block section being notched to form a first receiving space; a handle member pivotally connected under the hammering member, the handle section having a grip section, a first plate section, a second plate section and a third plate section being disposed at an upper end of the grip section to define a receiving chamber for inserting the protrusion block section therein; and a buffer assembly including a first compression spring received in the first receiving space.

The present invention can be best understood through the following description and accompanying drawings, wherein:

DETAILED DESCRIPTION OF THE PREFERRED EMBODIMENTS

Figure 1:
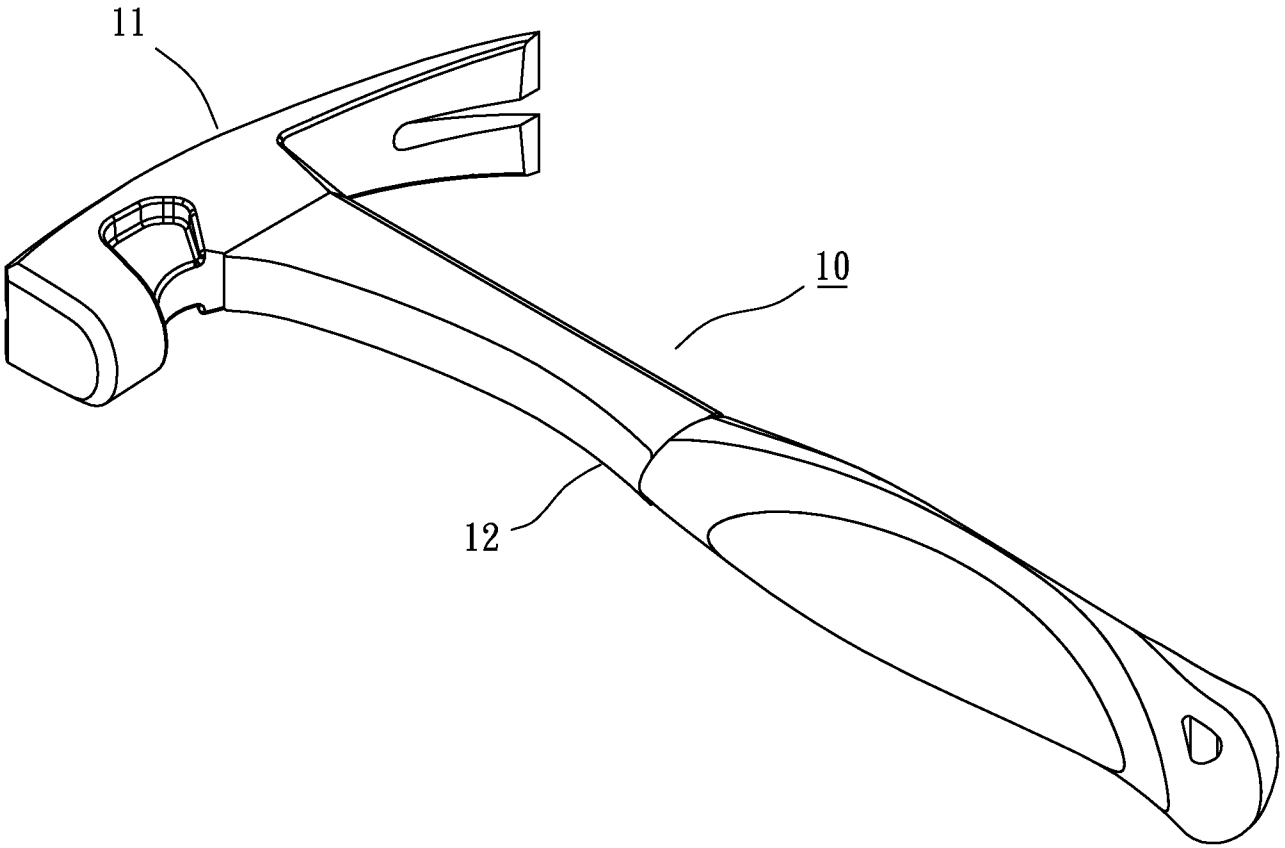
FIG. 1 PRIOR ART
FIG. 1 is a perspective view of a conventional hammer 10.
Figure 2:
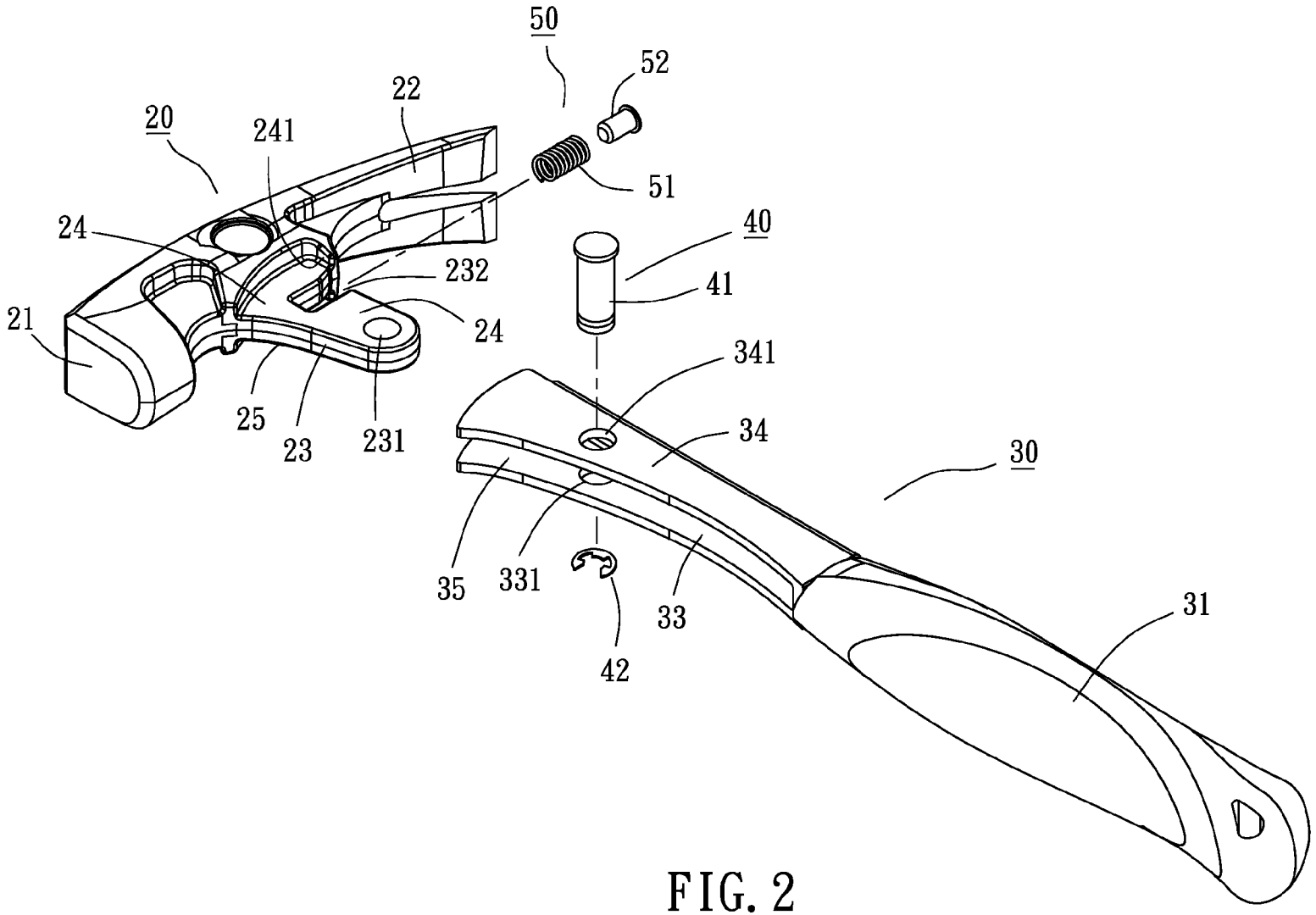
FIG. 2 is a perspective exploded view of a first embodiment of the present invention.
Figure 3:
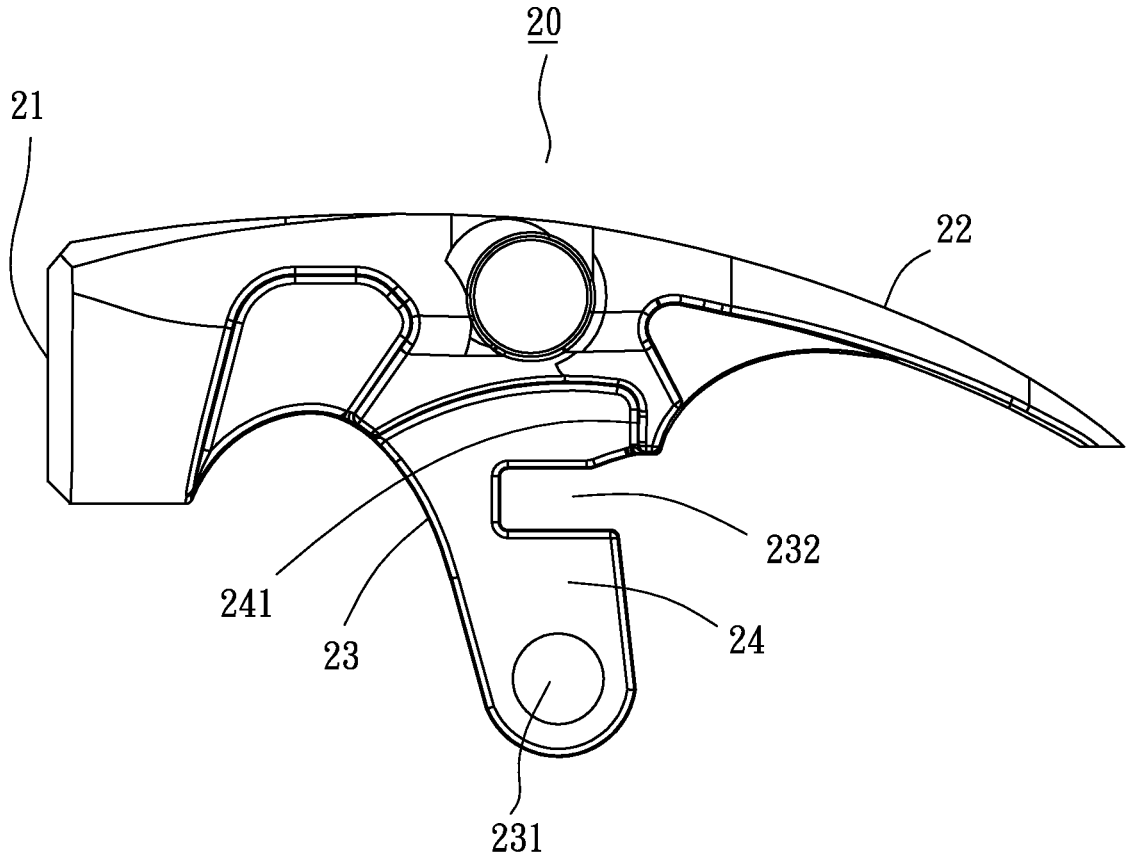
FIG. 3 is a top view of the hammering member 20 according to FIG. 2.
Figure 4:
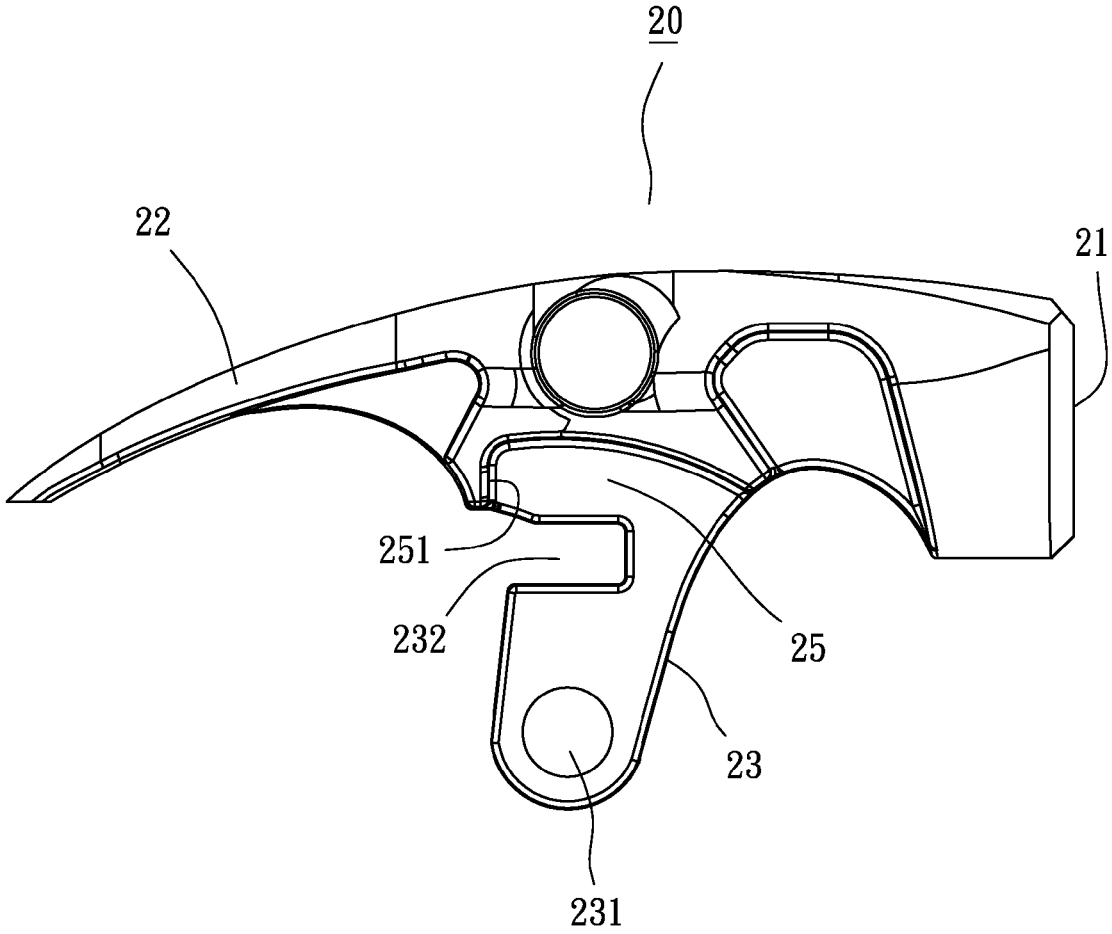
FIG. 4 is a bottom view of the hammering member 20 according to FIG. 2.
Figure 5:
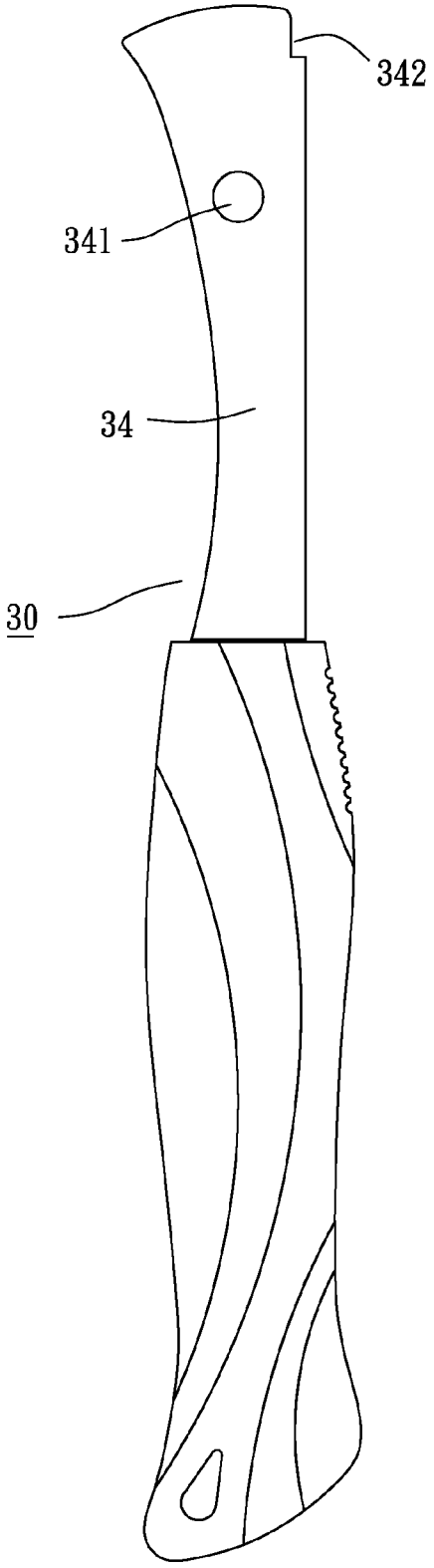
FIG. 5 is a top view of the handle member 30 according to FIG. 2.
Figure 6:
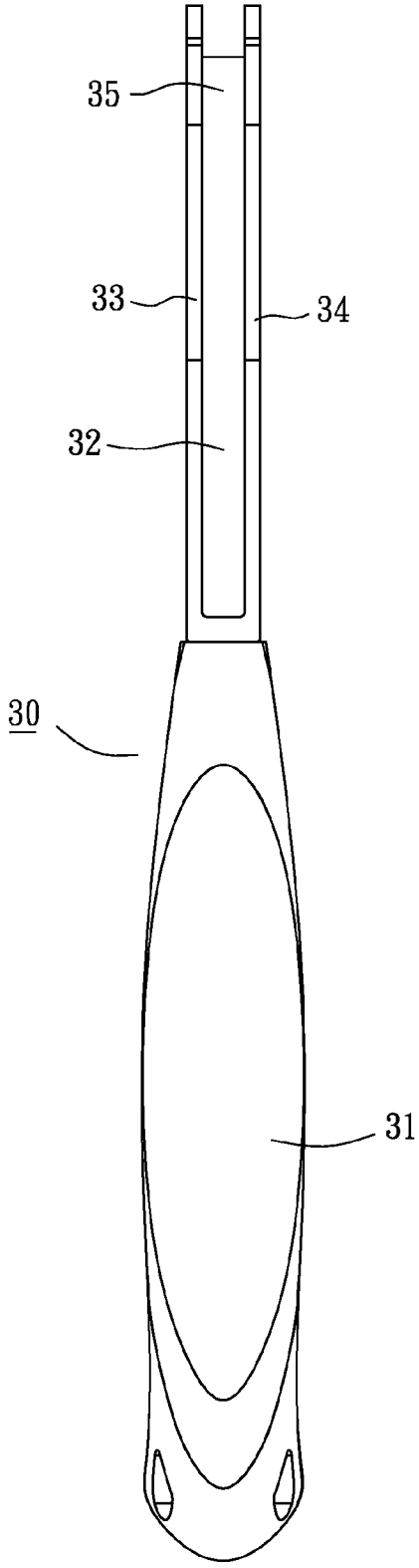
FIG. 6 is a left view of the handle member 30 according to FIG. 2.
Figure 7:
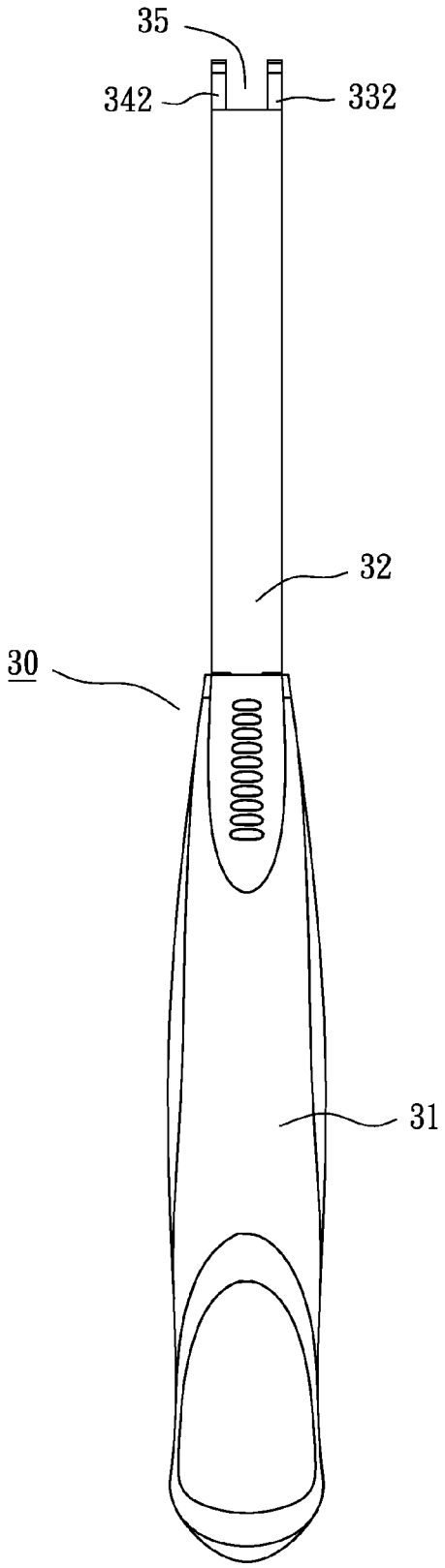
FIG. 7 is a right view of the handle member 30 according to FIG. 2.
Figure 8:
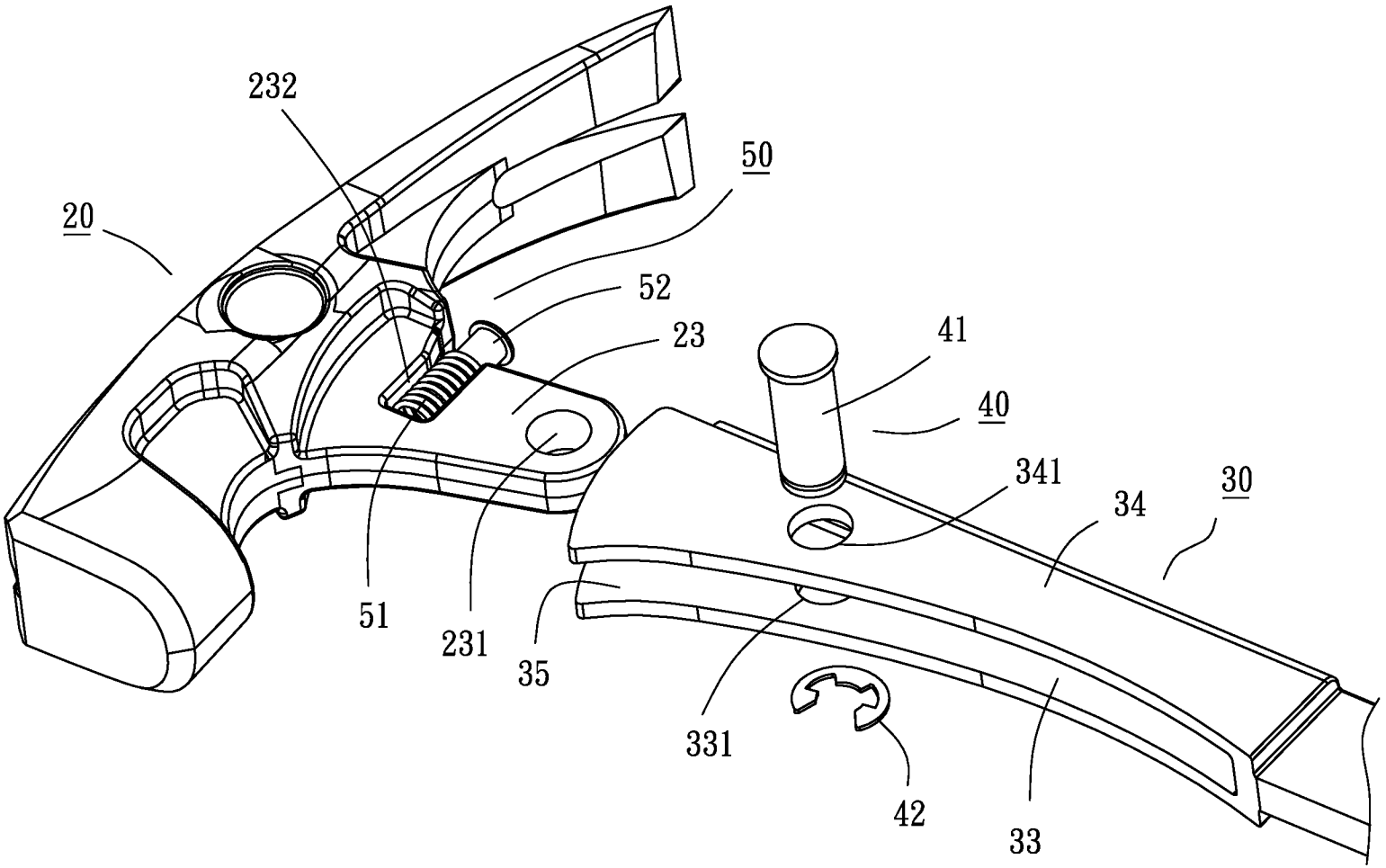
FIG. 8 is a perspective partially assembled view of the first embodiment of the present invention.
Figure 9:
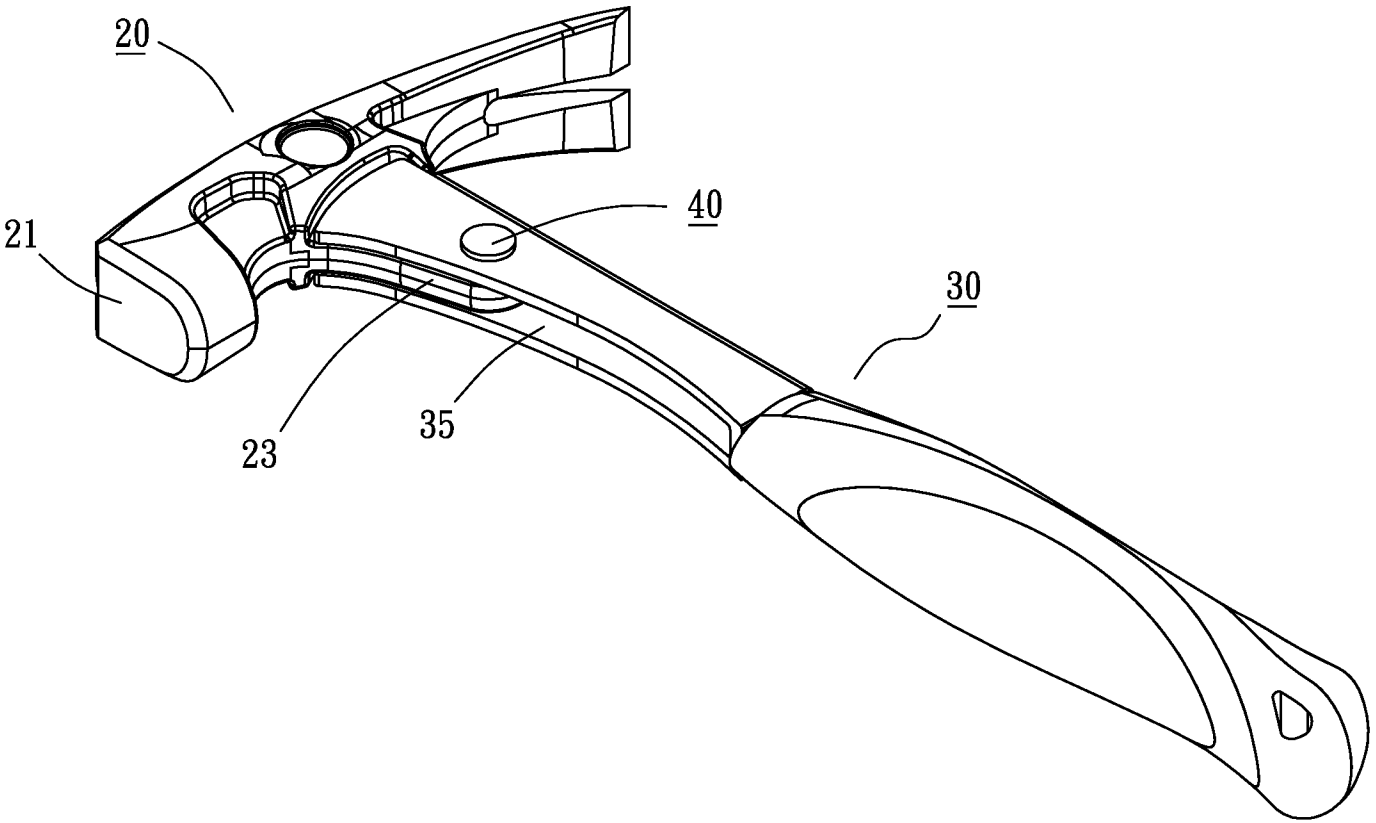
FIG. 9 is a perspective assembled view of the first embodiment of the present invention.

Please refer to FIGS. 2 to 11. According to a first embodiment, the hammering tool with buffer design of the present invention includes a hammering member 20 made of steel or other metal material. The hammering member 20 has a hammering section 21 and a nail pulling section 22 on a right side of the hammering section 21. A protrusion block section 23 extends from a lower side of the hammering member 20. A top section of the protrusion block section 23 is formed with a first depression 24. A bottom section of the protrusion block section 23 is formed with a second depression 25 corresponding to the first depression 24. A first stop section 241 is disposed on an upper right side of the first depression 24. The second depression 25 is provided with a second stop section 251 opposite to the first stop section 241. A lower end of the protrusion block section 23 is formed with a first through hole 231. A right side of upper section of the protrusion block section 23 is notched to form a first receiving space 232.

The hammering tool with buffer design of the present invention further includes a handle member 30 having a grip section 31 for a user to hold. A first plate section 32 upward extends from a right side of upper end of the grip section 31. A second plate section 33 leftward extends from a bottom edge of the first plate section 32. A third plate section 34 leftward extends from a top edge of the first plate section 32 corresponding to the second plate section 33. The first, second and third plate sections 32, 33, 34 together define a receiving chamber 35.

The second plate section 33 is formed with a second through hole 331 in a predetermined position corresponding to the first through hole 231 of the protrusion block section 23. The third plate section 34 is formed with a third through hole 341 corresponding to the first and second through holes 231, 331. A top end of right side of the second plate section 33 is formed with a third stop section 332. A top end of right side of the third plate section 34 is formed with a fourth stop section 342 corresponding to the third stop section 332. The protrusion block section 23 of the hammering member 20 is inserted in the receiving chamber 35 with the second plate section 33 positioned in the second depression 25 and the third plate section 34 positioned in the first depression 24.

The hammering tool with buffer design of the present invention further includes a pivot member 40 including a pin member 41 and a retainer member 42. The pin member 41 is sequentially passed through the third through hole 341, the first through hole 231 and the second through hole 331 and then retained with the retainer member 42.

The hammering tool with buffer design of the present invention further includes a buffer assembly 50 including a first compression spring 51 and a locating pin 52. The first compression spring 51 is received in the first receiving space 232 of the hammering member 20. A left end of the first compression spring 51 abuts against a left sidewall of the first receiving space 232. The locating pin 52 is inserted in a right section of the interior of the first compression spring 51. A right end of the locating pin 52 abuts against a left face of the first plate section 32. The locating pin 52 serves to stabilize the first compression spring 51 when the first compression spring 51 is forcedly deformed. However, the locating pin 52 is not an inevitable component.

Figure 10:
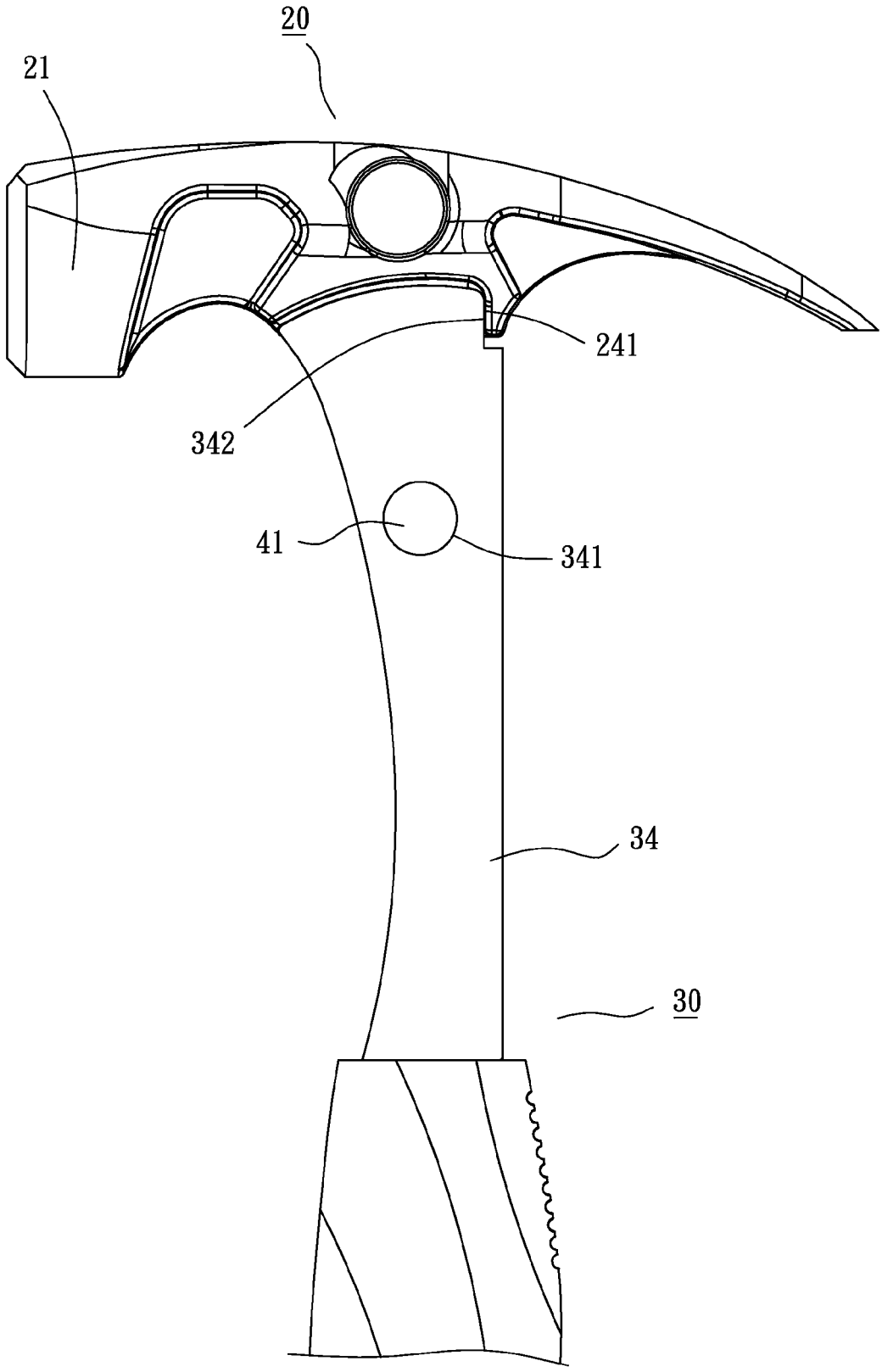
FIG. 10 is a top view of a part of the first embodiment of the present invention according to FIG. 9.
Figure 11:
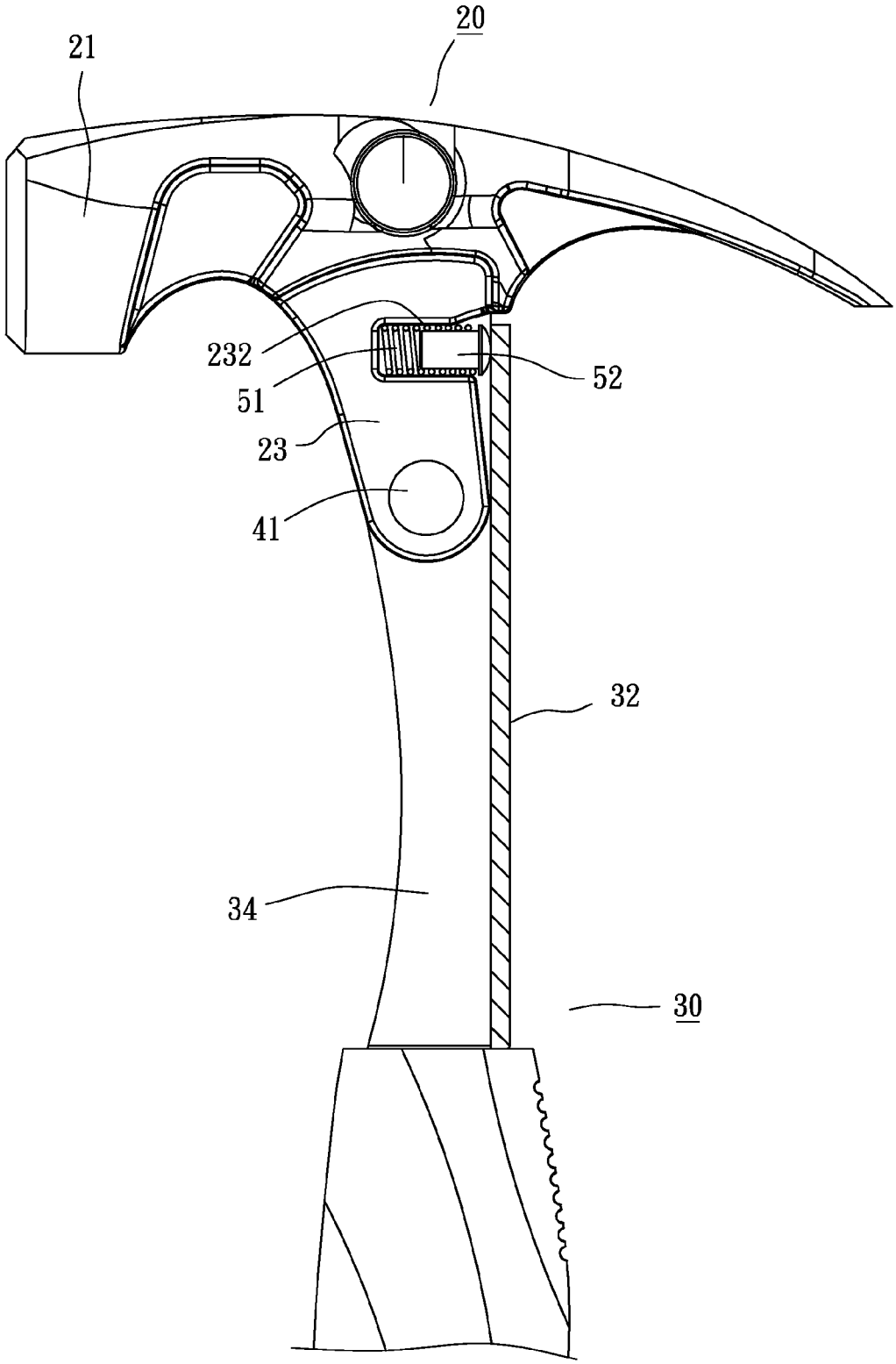
FIG. 11 is a partially sectional view according to FIG. 9.

Referring to FIGS. 10 and 11, in a normal state without hammering operation, the fourth stop section 342 abuts against the first stop section 241 of the hammering member 20, while the third stop section 332 abuts against the second stop section 251. In addition, the right end face of the protrusion block section 23 of the hammering member 20 is spaced from the left face of the first plate section 32 by a certain buffering distance.

Figure 12:
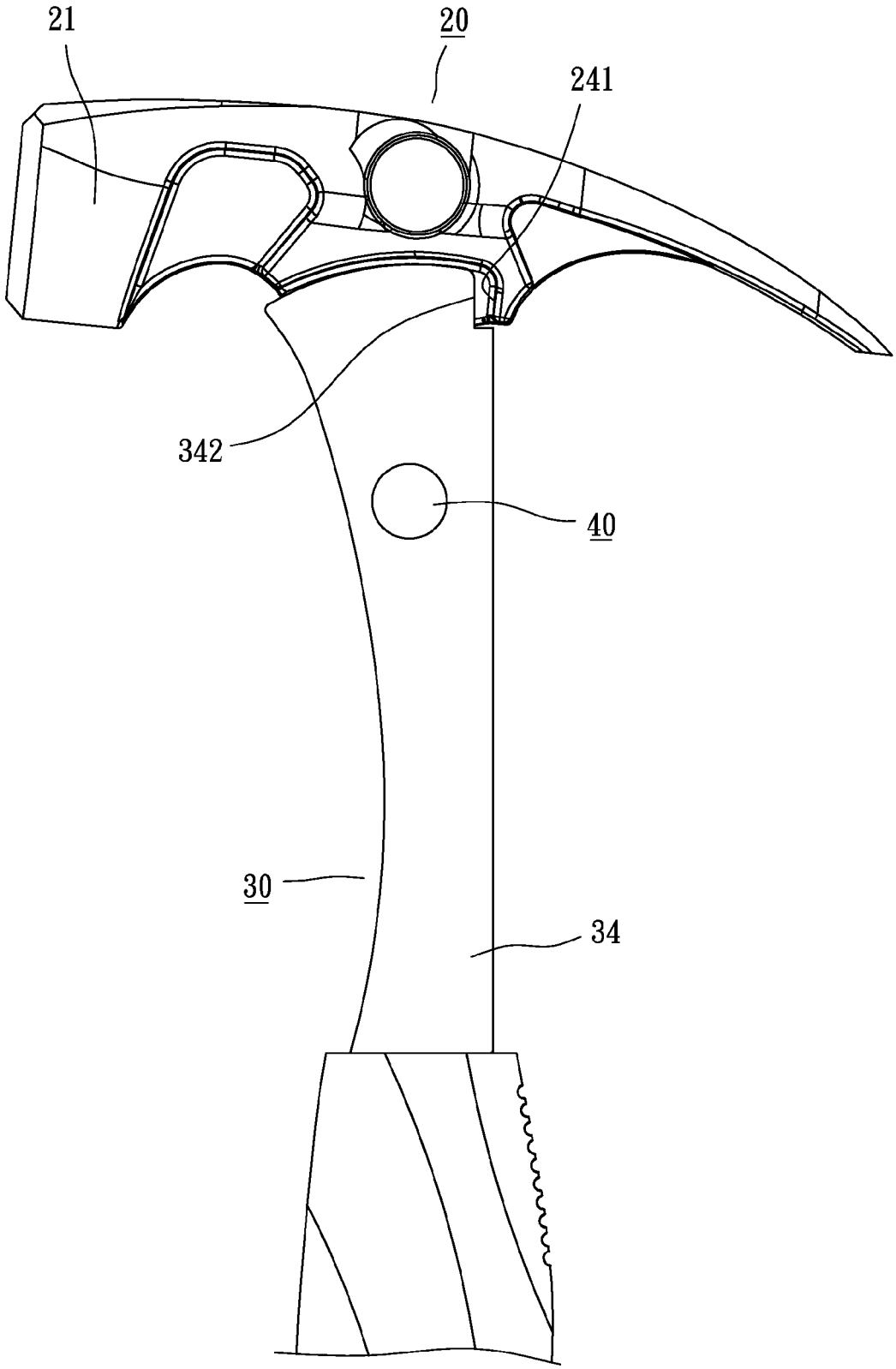
FIGS. 12 and 13 show the operation of the first embodiment of the present invention.
Figure 13:
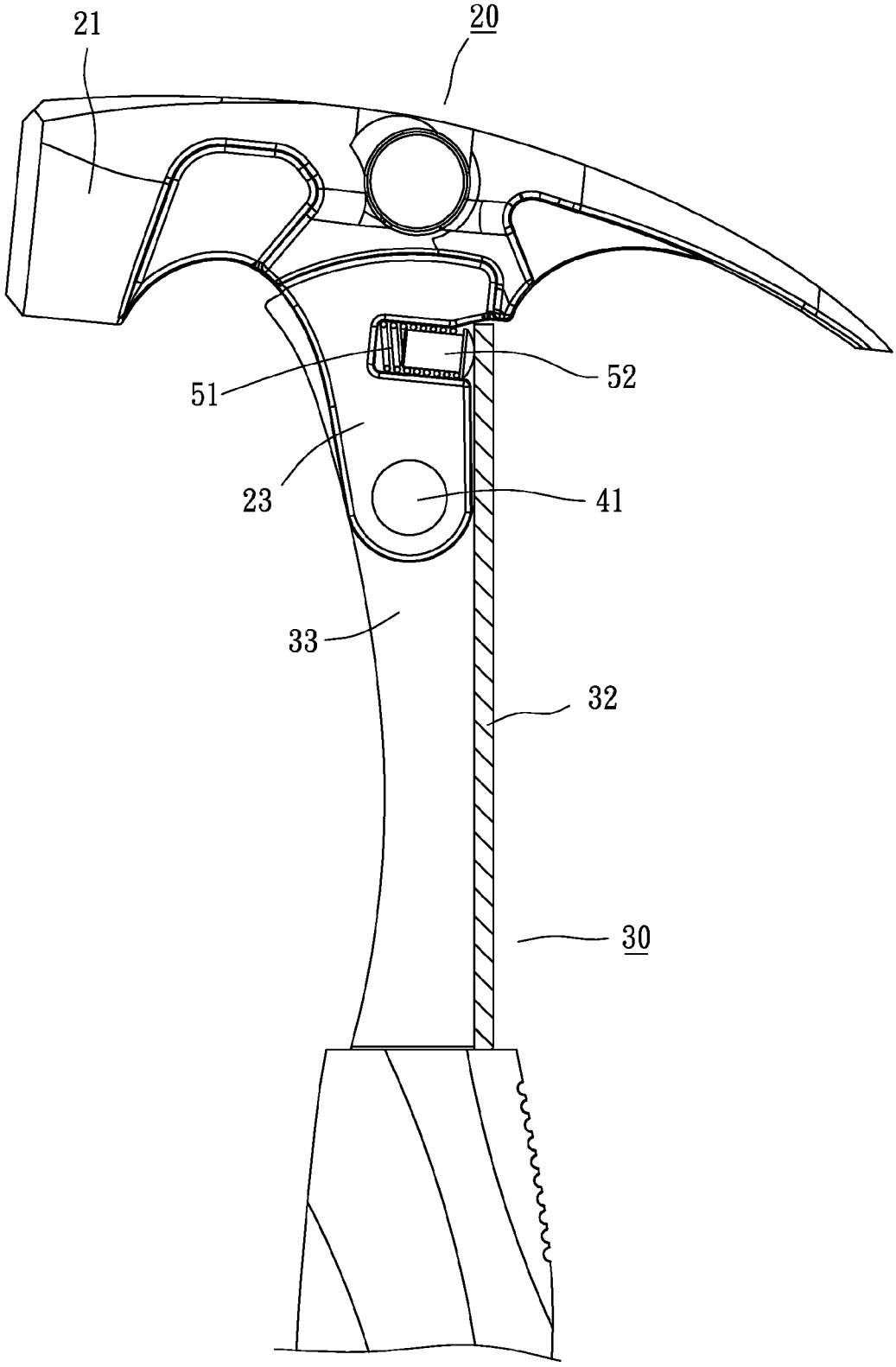

Please further refer to FIGS. 12 and 13. When a user holds the grip section 31 to hammer a work piece with the hammering member 20, the instantaneously created reaction force will make the first compression spring 51 compressed and deformed until the right end of the protrusion block section 23 touches the left face of the first plate section 32. In the operation, the first compression spring 51 provides a buffering and damping effect to greatly decay the impact force so as to minimize the possible injury to the user's hand and ensure health of a labor's body. When the hammering member 20 leaves the work piece, the first compression spring 51 restores to its original state as shown in FIGS. 10 and 11.

Figure 14:
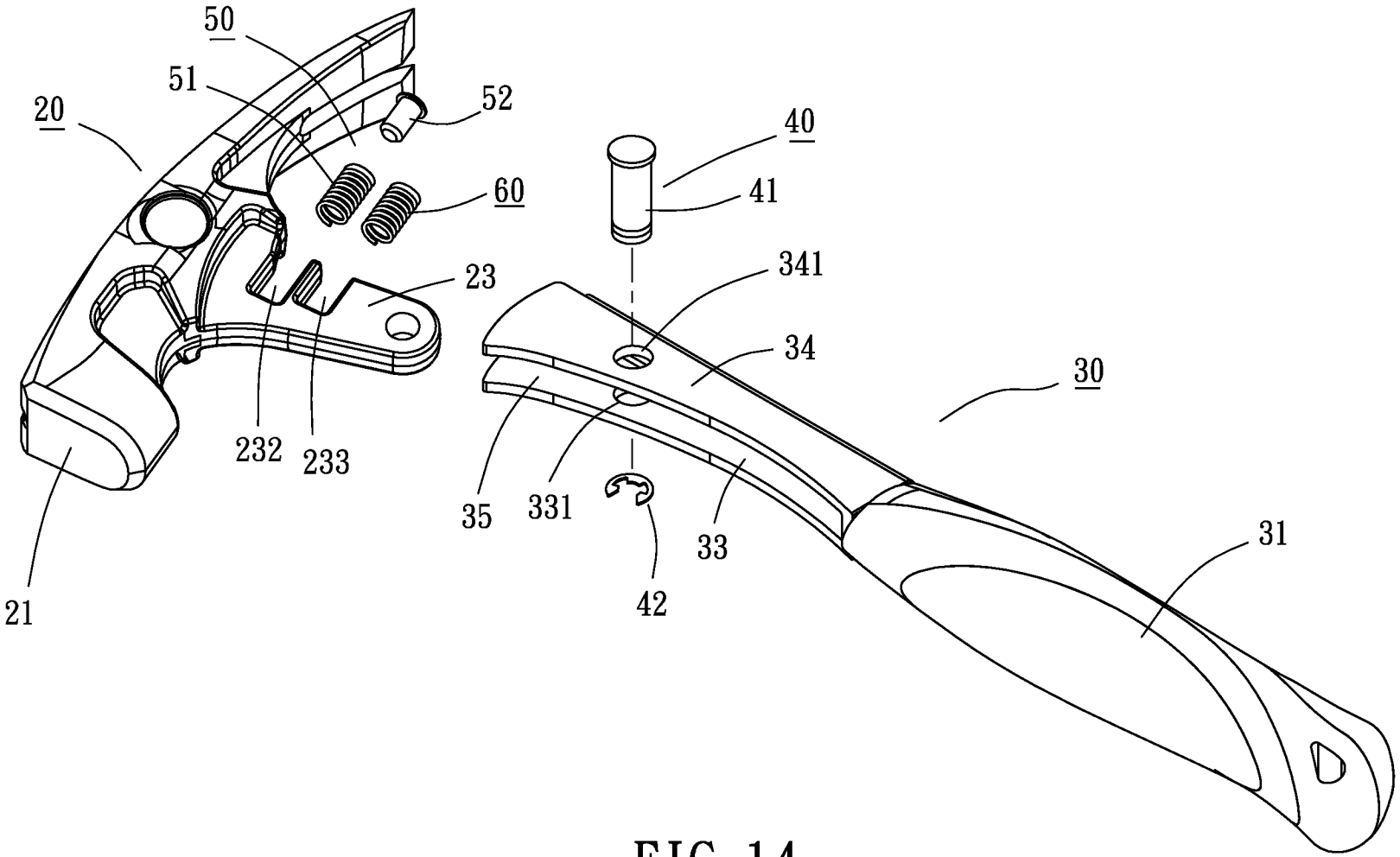
FIGS. 14 and 15 show the structure of a second embodiment of the present invention.
Figure 15:
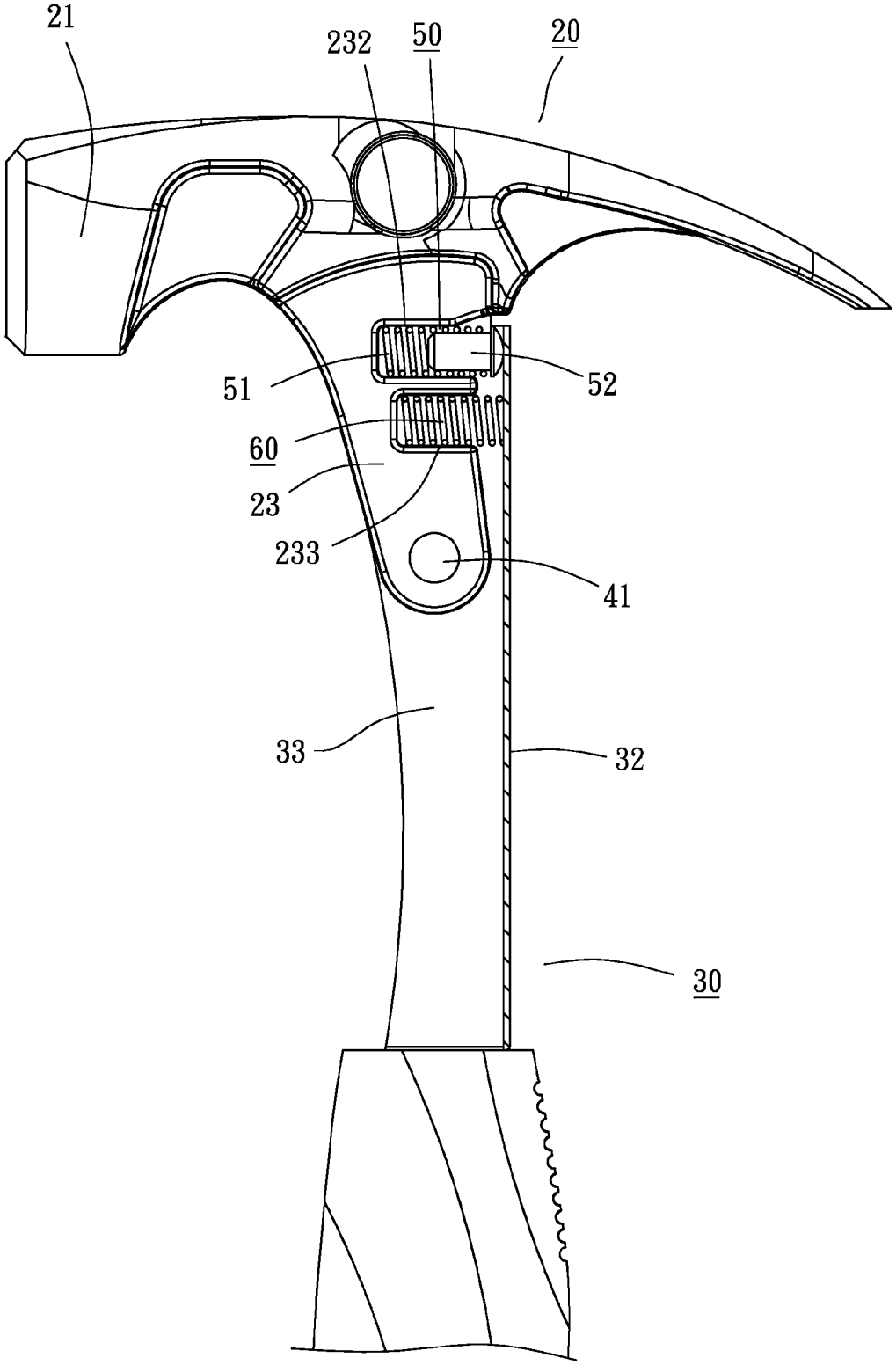

Please now refer to FIGS. 14 and 15, which show a second embodiment of the present invention. The second embodiment is different from the first embodiment in that the hammering member 20 is further formed with a second receiving space 233 under the first receiving space 232 for receiving a second compression spring 60. Such arrangement is applicable to a hammering tool with heavier weight and larger size to provide better anti-shock effect.

The above embodiments are only used to illustrate the present invention, not intended to limit the scope thereof. Many modifications of the above embodiments can be made without departing from the spirit of the present invention.

What is claimed is:

1. A hammering tool with buffer design, comprising:

a hammering member having a hammering section, a protrusion block section extending from a lower side of the hammering member, a top section of the protrusion block section being formed with a first depression, a bottom section of the protrusion block section being formed with a second depression corresponding to the first depression, a first stop section being disposed on an upper right side of the first depression, the second depression being provided with a second stop section opposite to the first stop section, a lower end of the protrusion block section being formed with a first through hole, a right side of upper section of the protrusion block section being notched to form a first receiving space;

a handle member having a grip section for a user to hold, a first plate section upward extending from a right side of upper end of the grip section, a second plate section leftward extending from a bottom edge of the first plate section, a third plate section 34 leftward extends from a top edge of the first plate section corresponding to the second plate section, the first, second and third plate sections together defining a receiving chamber, the second plate section being formed with a second through hole in a predetermined position corresponding to the first through hole of the protrusion block section, the third plate section being formed with a third through hole corresponding to the first and second through holes, a top end of right side of the second plate section being formed with a third stop section, a top end of right side of the third plate section being formed with a fourth stop section corresponding to the third stop section, the protrusion block section of the hammering member being inserted in the receiving chamber with the second plate section positioned in the second depression and the third plate section positioned in the first depression;

a pivot member sequentially passed through the third through hole, the first through hole and the second through hole for pivotally connecting the protrusion block section of the hammering member with the handle member; and a buffer assembly including a first compression spring received in the first receiving space of the hammering member, a left end of the first compression spring abutting against a left sidewall of the first receiving space, a right end face of the protrusion block section of the hammering member being spaced from the left face of the first plate section by a certain buffering distance, the fourth stop section of the handle member abutting against the first stop section of the hammering member, while the third stop section abutting against the second stop section.

2. The hammering tool with buffer design as claimed in claim 1, wherein the buffer assembly further includes a locating pin, the locating pin being inserted in a right section of the interior of the first compression spring, a right end of the locating pin abutting against the left face of the first plate section, a left end of the locating pin being spaced from the left sidewall of the first receiving space by a predetermined distance.

3. The hammering tool with buffer design as claimed in claim 2, wherein the pivot member includes a pin member and a retainer member, the pin member being sequentially passed through the third through hole, the first through hole and the second through hole and then retained with the retainer member.

4. The hammering tool with buffer design as claimed in claim 1, wherein the hammering member is further formed with a second receiving space under the first receiving space for receiving a second compression spring.

5. The hammering tool with buffer design as claimed in claim 3, wherein the hammering member is further formed with a second receiving space under the first receiving space for receiving a second compression spring.

6. The hammering tool with buffer design as claimed in claim 2, wherein the hammering member is further formed with a second receiving space under the first receiving space for receiving a second compression spring.

* * * * *